US008210526B2

(12) United States Patent
Ponti

(10) Patent No.: US 8,210,526 B2
(45) Date of Patent: Jul. 3, 2012

(54) DEVICE FOR HORIZONTALLY ROTATING FLAT ARTICLES SUPPLIED ALONG A TRANSPORT LINE

(75) Inventor: Francesco Ponti, Cerbara-Citta'di Castello (IT)

(73) Assignee: C.M.C. S.r.l., Cerbara-Citta' di Castello (Perugia) (IT)

( * ) Notice: Subject to any disclaimer, the term of this patent is extended or adjusted under 35 U.S.C. 154(b) by 0 days.

(21) Appl. No.: 13/063,439

(22) PCT Filed: Sep. 9, 2009

(86) PCT No.: PCT/IB2009/006789

§ 371 (c)(1),
(2), (4) Date: Mar. 10, 2011

(87) PCT Pub. No.: WO2010/029408

PCT Pub. Date: Mar. 18, 2010

(65) Prior Publication Data

US 2011/0163494 A1 Jul. 7, 2011

(30) Foreign Application Priority Data

Sep. 10, 2008 (IT) ..... BO2008A0544

(51) Int. Cl.
*B65H 29/00* (2006.01)

(52) U.S. Cl. ..... 271/184; 271/185

(58) Field of Classification Search ..... 271/184, 271/185; 198/415

See application file for complete search history.

(56) References Cited

U.S. PATENT DOCUMENTS

| | | | | |
|---|---|---|---|---|
| 4,877,234 | A | 10/1989 | Mandel | |
| 5,172,907 | A | 12/1992 | Kalisiak | |
| 5,860,646 | A | 1/1999 | Fowler | |
| 6,480,697 | B2 * | 11/2002 | Kojima | 399/404 |

FOREIGN PATENT DOCUMENTS

JP 02276746 A * 11/1990

OTHER PUBLICATIONS

International Search Report, Jan. 26, 2010.

* cited by examiner

*Primary Examiner* — David H Bollinger
(74) *Attorney, Agent, or Firm* — William J. Sapone; Coleman Sudol Sapone P.C.

(57) ABSTRACT

A device for horizontally rotating flat articles supplied along a transport line (L) has a sliding plane (2) for restively receiving articles (F) in transit between the upstream and downstream branches (RM, RV). Two drawing groups are flanked and activated independently, each constituted by a lower roller (13, 14) and an upper roller (23, 24) rotating in an opposite direction, the rollers adheringly engaging with upper and lower surfaces of the flat articles (F). Command organs (10) activate the first and second drawing groups (3, 4), first in a same direction in phase relation with an entry of a flat article (F) arriving from the upstream branch (RM) and then in opposite directions in order to horizontally rotate the flat article (F) by a predetermined angle, and once more in a same direction for directing the rotated flat article (F) towards the downstream branch (RV) of the transport line (L), in a direction parallel to the entry direction.

7 Claims, 6 Drawing Sheets

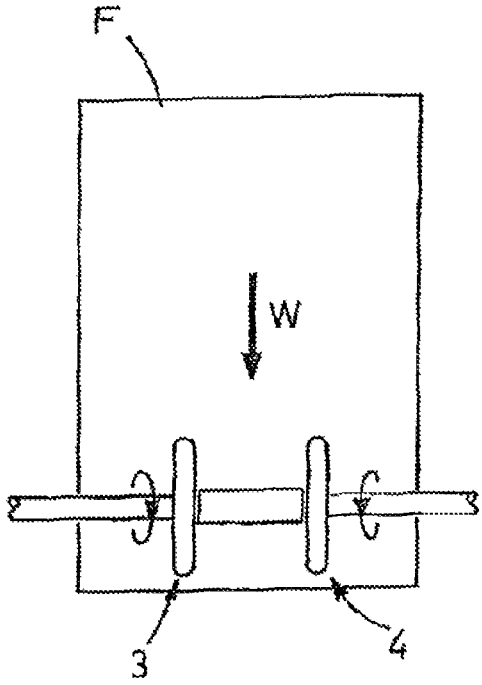
FIG. 6
FIG. 7
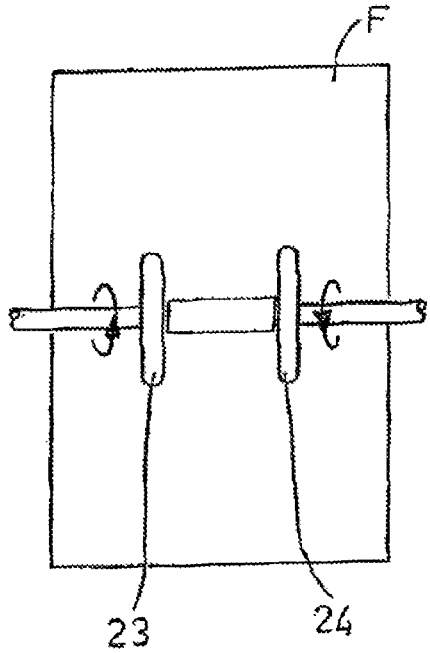
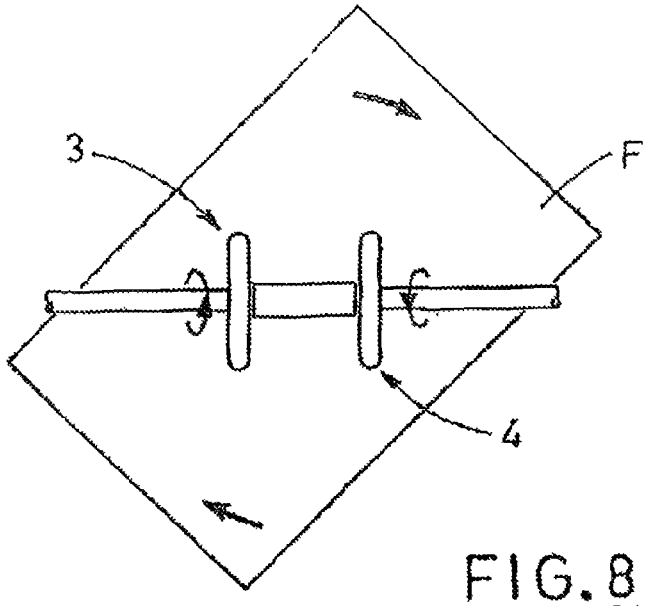
FIG. 8

FIG. 9
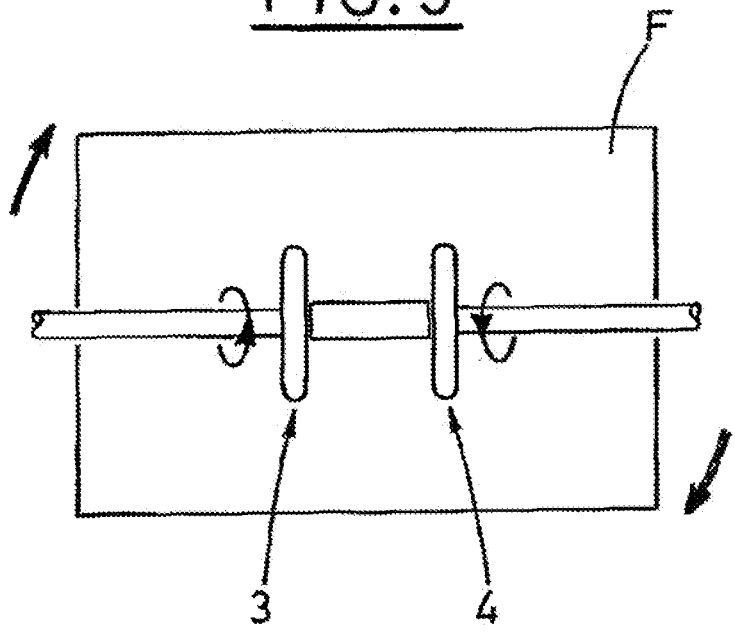
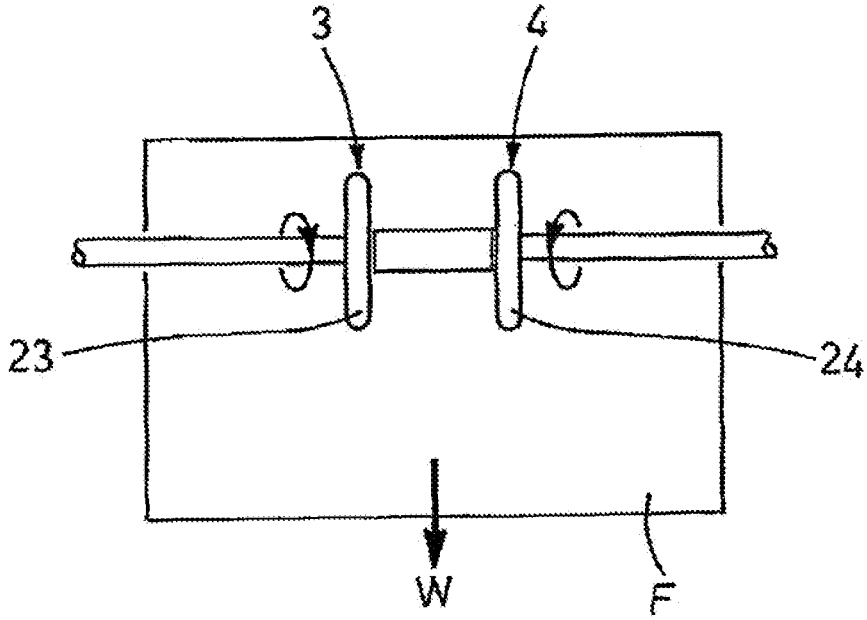
FIG. 10

DEVICE FOR HORIZONTALLY ROTATING FLAT ARTICLES SUPPLIED ALONG A TRANSPORT LINE

TECHNICAL FIELD

The invention relates to the technical sector or automatic machines for putting sheets or piles, constituted by documents, printed advertising and the like, into envelopes.

BACKGROUND ART

Production requirements are such that the machines have to be able to reach very high operating speeds.

In a first machine of known type, schematically illustrated in the lay-out of FIG. 1, there is a first station S1 in which the sheets F are piled in a store M from which they are extracted one by one and placed in a straight transport line L which in reality is much longer than it appears in FIG. 1.

A second station (not illustrated) can be located downstream of the first station S1, in which a predetermined number of sheets F is stacked to form a pile.

The formation of the piles can be done in various ways, for example by successive layering operated by a battery of devices, known as "sheet feeders"; in this case, the second station can have a considerable longitudinal development which leads to a consequent increase in length of the conveyor line.

The single sheets F (or the piles) are transferred from the line L towards an envelope packaging station S2, into which the envelopes B are introduced.

The characteristics of the envelope B, in particular the location of the open side thereof, determine the orientation with which the sheet F or the pile have to reach the packaging station S2.

When the opening of the envelope B is on a short side, the sheet F is extracted from the store M parallel to the long side thereof, and in this "portrait" orientation it is transported by the line L up to the envelope packaging station S2.

This operating situation (not illustrated) is the best one for guaranteeing excellent guiding of the sheets F along the line L, also at high speed.

When the opening of the envelope B is on a long side, the sheet F has to be turned by 90° with respect to the preceding case; this orientation, known as "landscape", is the one illustrated in FIG. 1.

It is easy to see how the stability of the sheets F, fed along the line L with this orientation, is much more precarious, even when the operating speed is not particularly rapid.

In another machine of known type, destined to fill envelopes B with the opening on the long side and schematically illustrated in the lay-out of FIG. 2, the sheets F are stacked in the store M such that the extraction is performed in the portrait direction.

With the same orientation the sheets F are in-fed and transported along the first part of the transport line L, beyond a successive station (if present) for forming a pile; in this way the greater precision in the sheet F guide can be exploited, with a greater stability of the sheets.

A terminal tract of the transport line L is arranged perpendicular to the first part and the sheets F (or piles), due to the change of direction necessary to be put into the terminal part, change their orientation to landscape so that they are correctly orientated in the envelope packaging station S2.

It is entirely evident that with this machine configuration the critical point is located in the zone in which the transport line L deviates by 90°, where the sheets, but especially the piles, risk losing the correct position, causing blockages in the machine; consequently the possibility of reaching high operating velocities is precluded.

The aim of the present invention is thus to provide a device for horizontal rotation of flat articles along a conveyor line, suitable for being associated to an automatic machine for packaging in envelopes sheets or piles, conformed in order to perform its function while maintaining the relative conveyor line with a straight development, with the aim of reaching high operating velocities.

A further aim of the invention relates to the desire to provide a device which can be activated or deactivated on command and, if inoperative, a device which is developed such as to enable in any case the transit of the articles without interference, such as to increase the versatility of the machine on which it is mounted.

A further aim of the invention consists in providing a device which is destined to perform rotations of the articles to any angle and in either direction, such as to broaden the scope of application thereof beyond the original functions.

A further aim of the invention is to provide a device of simple conception, of limited size in the development direction of the conveyor line to which it is associated, and, not least, relatively inexpensive.

DISCLOSURE OF INVENTION

The aforementioned aims are obtained by means of a device for horizontally rotating flat articles supplied along a transport line, which comprises: a sliding plane interposed between an upstream branch and a downstream branch of the line, destined to restingly receive the articles in transit between the branches; two lower drawing rollers, coaxial and having a same diameter, arranged below the sliding plane, at openings realized therein, such that a common axis of rotation is horizontal and perpendicular to the transport line and such that an upper limit of the respective external circumferences is not lower than a surface of the sliding plane; two upper drawing rollers coaxial and having a same diameter, arranged above the lower drawing rollers and aligned there-with, having a common axis of rotation which is parallel to the axis of rotation of the lower rollers and destined to defined with the lower rollers a first drawing group and a second drawing group, flanking one another, each of which is constituted by one of the lower rollers and by a corresponding upper roller, with the rollers of each group destined to adheringly engage upper surfaces and lower surfaces of the flat articles; a first motor means and a second motor means destined to operate, independently of one another, the corresponding first drawing group and second drawing group, in predetermined rotating directions, such that the rollers of each of the first drawing group and second drawing group are in any case counter-rotating; command organs for activating the first and second motor means such that: initially the first drawing group and the second drawing group rotate in a same direction, in phase relation with the inlet of a flat article between the rollers of the first and second drawing groups, the flat article coming from the upstream branch of the transport line; then the first drawing group and the second drawing group rotate in an opposite direction, in order to horizontally rotate the flat article by a predetermined angle; and subsequently the first drawing group and the second drawing group rotate again in a same direction in order to cause the flat article, now rotated, to exit towards the downstream branch of the transport line, in a parallel direction to the inlet direction.

BRIEF DESCRIPTION OF THE DRAWINGS

The characteristics of the invention will emerge from the following description of a preferred embodiment of the device, in agreement with what is set out in the claims and with the aid of the accompanying tables of drawings, in which:

FIGS. 6, 7, 8, 9, 10 illustrate schematic plan views of the device, in successive operating stages;

BEST MODE FOR CARRYING OUT THE INVENTION

With reference to the figures of the drawings, the device of the invention has been denoted in its entirety by 1.

The device 1 is destined to perform a horizontal rotation to a predetermined angle of flat articles, for example sheets F, or piles formed by a certain number of previously-piled sheets, as described in the premises.

Figure 11:
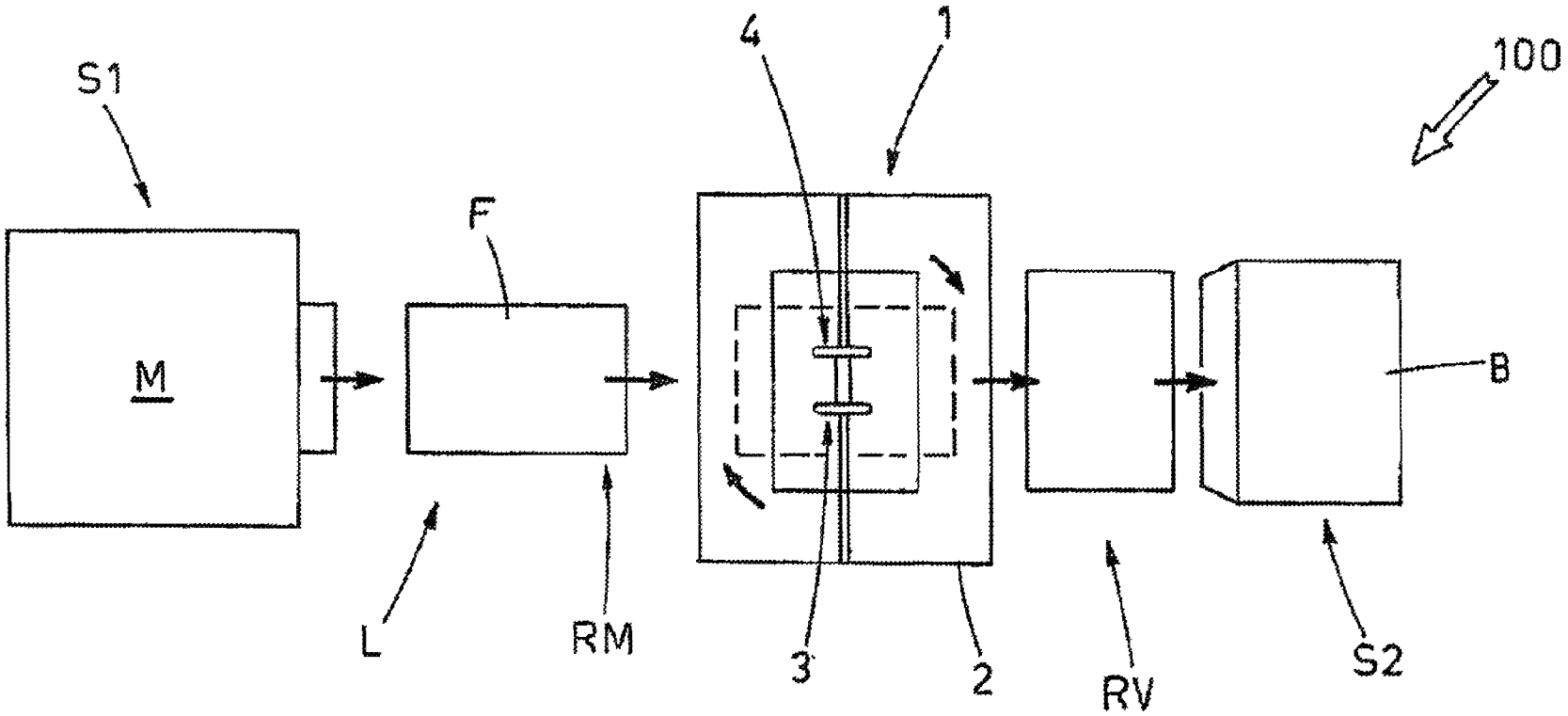
FIG. 11 is a schematic plan view of a lay-out of an automatic machine for packaging envelopes provided with the device of the invention.

For this application, the device 1 is associated to a known automatic machine for packaging envelopes, illustrated in FIG. 11 and denoted in its entirety by 100.

In the machine 100, similarly to what is described in the preamble hereto with reference to the prior art, a first station S1 is included in which the sheets F are stacked in a store M, from which they are extracted one by one and placed into a straight transport line L.

The sheets F are always extracted from the store M parallel to the longer side thereof, in a portrait orientation, i.e. the better orientation for guaranteeing an optimal guiding of the sheets F along the line L, even at high speed.

As in the machines indicated in the preamble, a second station (not illustrated) can be included in the machine 100, downstream of the first station, in which a predetermined number of sheets F is stacked to form a pile.

The device 1 is arranged along the transport line L, after the pile-forming stage, if present, and immediately before a packaging station S2, similar to the station described in the preamble hereto.

The device 1 comprises a sliding plane 2 interposed between an upstream branch RM and a downstream branch RV of the line L, destined to restingly receive the sheets F, or piles, transiting on the branches.

The sliding plane 2 exhibits a greater width than the transport line L, in order to enable the rotation of the sheets F, as explained herein below.

Below the sliding plane 2 there are located two coaxial and same-diameter lower drawing rollers 13, 14, arranged at openings 2A, 2B realised in the plane 2, such that the common rotation axis X1 is horizontal and perpendicular to the transport line L and the upper limit of the respective external circumferences is slightly higher than or, at least, aligned with the surface 2S of the sliding plane 2.

Two upper drawing rollers 23, 24 are located above the lower drawing rollers 13, 14 and are coaxial thereto and have the same diameter.

The common rotation axis X2 of the upper drawing rollers 23, 24 is parallel to the axis X1 of the lower rollers 13, 14.

In the example of the figures, the lower rollers 13, 14 and the upper rollers 23, 24 all have the same diameter.

The lower roller 13 and the corresponding upper roller 23 define a first drawing group 3, flanked by a second group 4 in turn constituted by the remaining lower roller 14 and by the respective upper roller 24.

The rollers 13, 23, 14, 24 of each group 3, 4 are destined to adheringly engage the upper surfaces and the lower surfaces of the sheets F or piles, as will be more fully described herein below.

The device 1 further comprises first and second motor organs 30, 40 destined to activate, independently of one another, the corresponding first and second drawing group 3, 4 by means of first and second transmission organs 31, 41.

The first motor organ 30 and the connected first transmission organs 31 are supported by a first vertical wall 5 fixed laterally to the sliding plane 2; symmetrically, the second motor organs 40 and the connected second transmission organs 41 are supported by a second vertical wall fixed to the opposite side of the same sliding plane 2.

Each of the transmission organs 31, 41 is constituted by a motor pulley 32, 42 destined to activated two driven pulleys 34A, 34B, 44A, 44B via a cogged belt or chain, the two driven pulleys 34A, 34B, 44A, 44B being keyed on respective lower axles 35, 45 and upper axles 36, 46, connected with the corresponding lower roller 13, 14 and with the upper roller 23, 24.

The trajectory of the cogged belt 33, 43 develops such as to activate the driven pulleys 34A, 34B, 44A, 44B in opposite directions, such that the corresponding lower rollers 13, 14 and upper rollers 23, 24 are equally counter-rotating; to this end, each transmission group 31, 41 further comprises an idle pulley 37, 47, specially positioned in order to obtain the desired trajectory of the cogged belt 33, 43.

Figure 1:
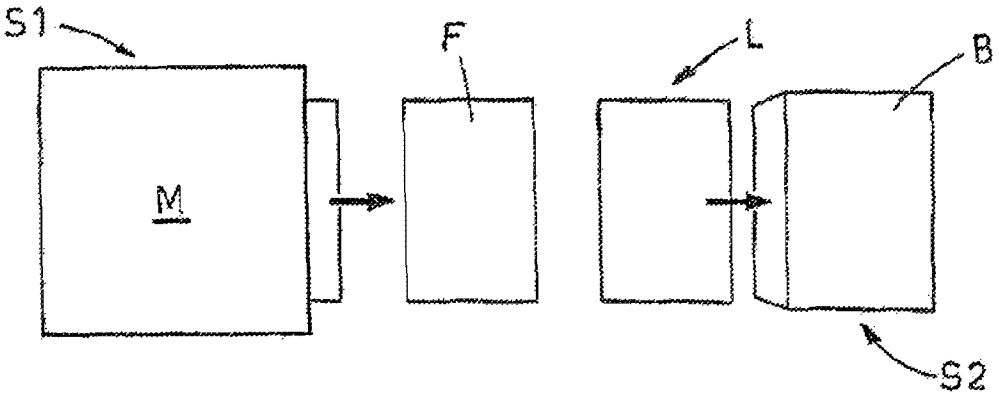
FIG. 1 PRIOR ART
FIGS. 1 and 2 schematically illustrate, in plan view, respective lay-outs of known automatic machines for packaging envelopes.
Figure 2:
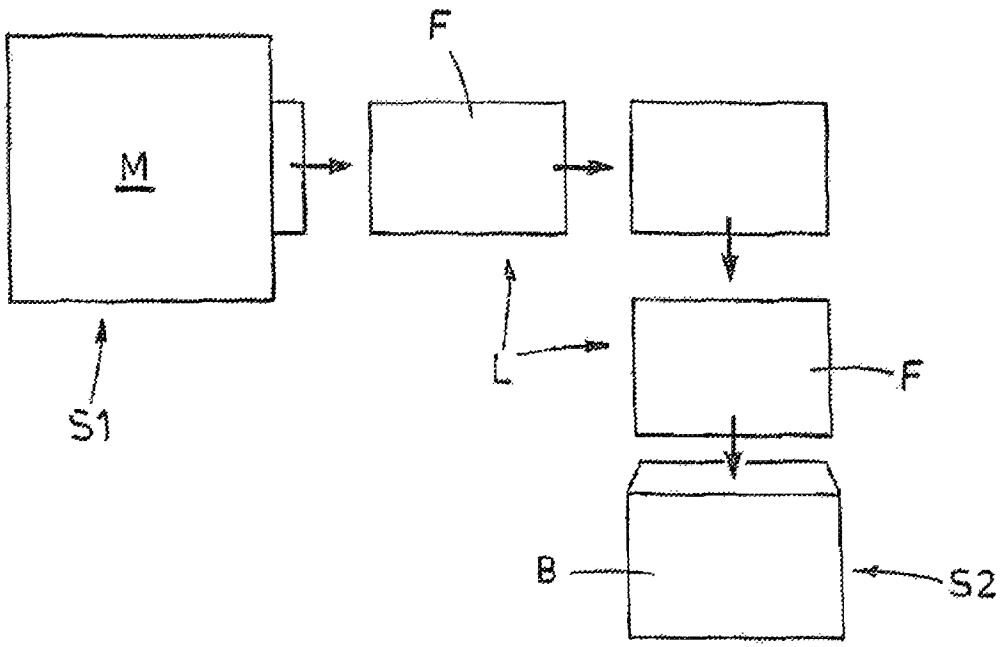
FIG. 2 PRIOR ART
Figure 3:
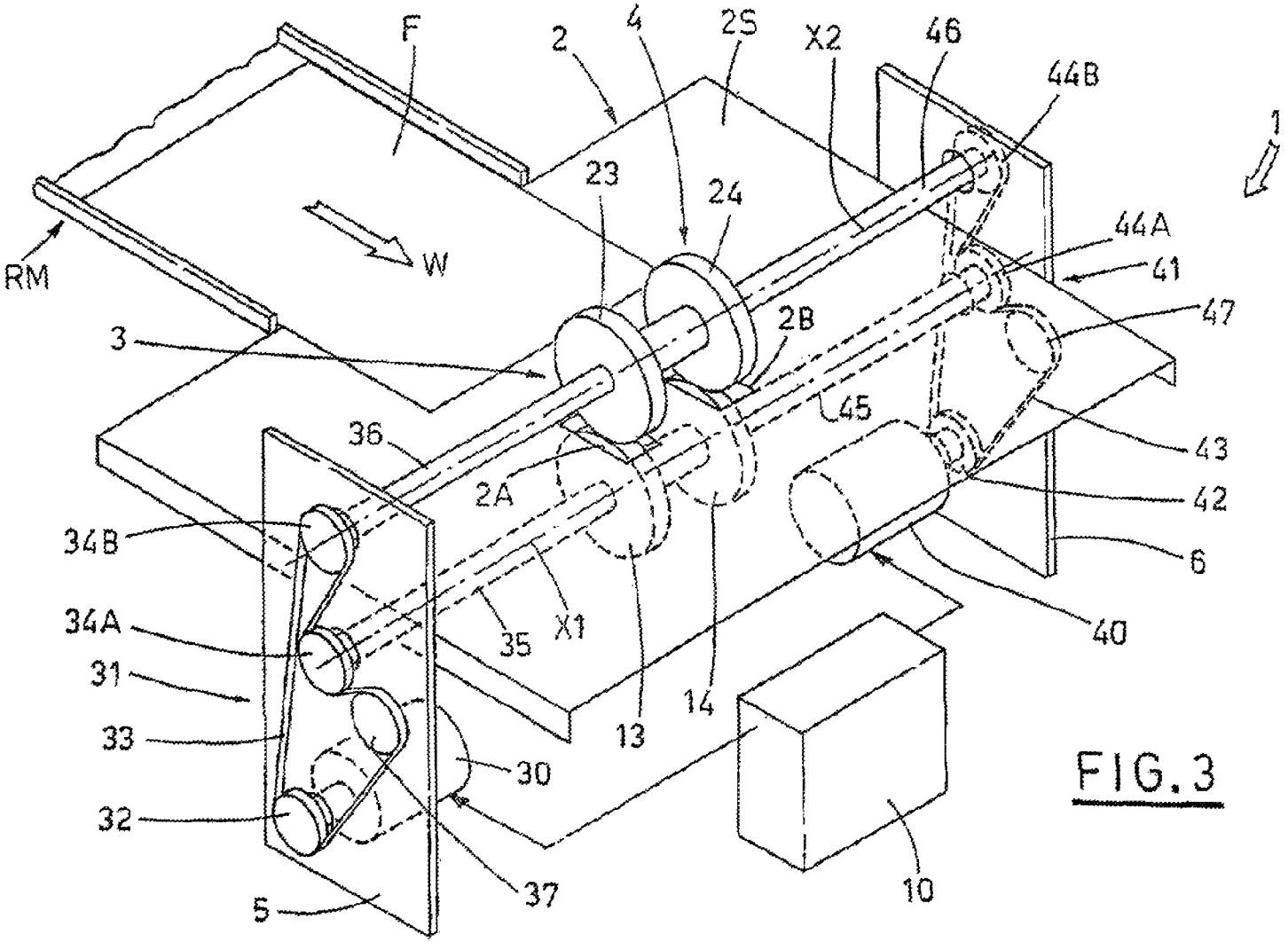
FIG. 3 is an axonometric view of the device of the invention.

FIG. 3 illustrates the simplest constructional solution, with all the axles 35, 36, 45, 46 of a rigid type, and with the lower rollers 13, 14 and the upper rollers 23, 24 arranged with a fixed interaxis, calculated according to a constant thickness of the flat article destined to be inserted between them.

Figure 4A:
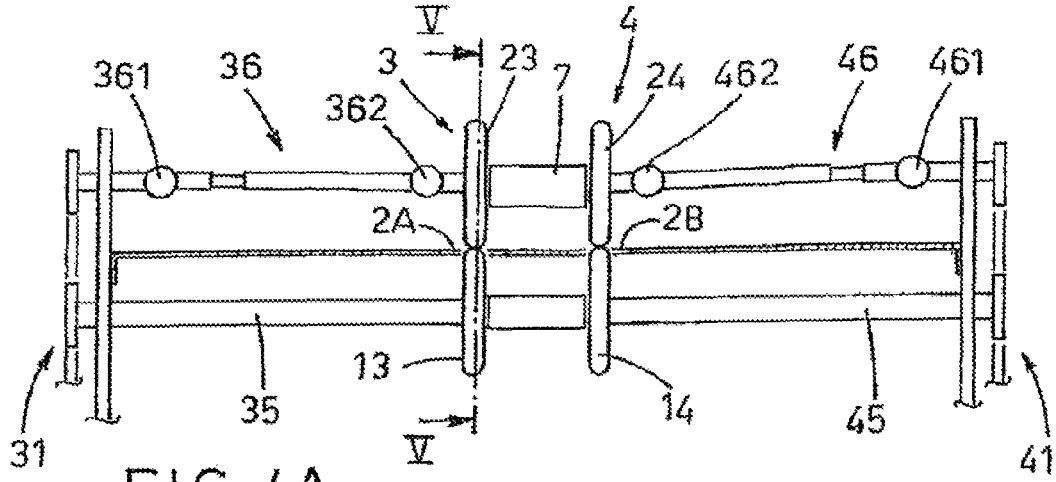
FIGS. 4A, 4B illustrate two partial front views of the device in two different operating conditions.
Figure 5:
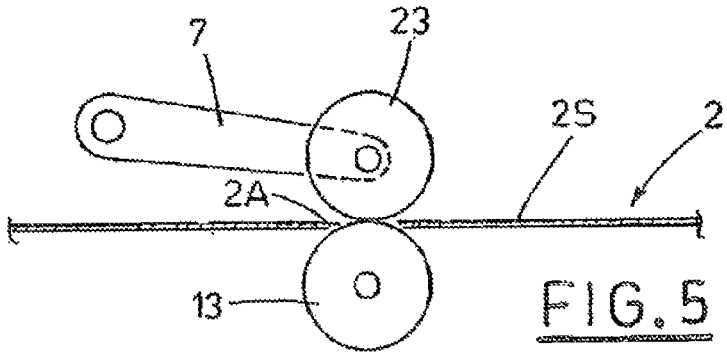
FIG. 5 is a partial section of the device, obtained along plane V-V of FIG. 4.
Figure 4B:
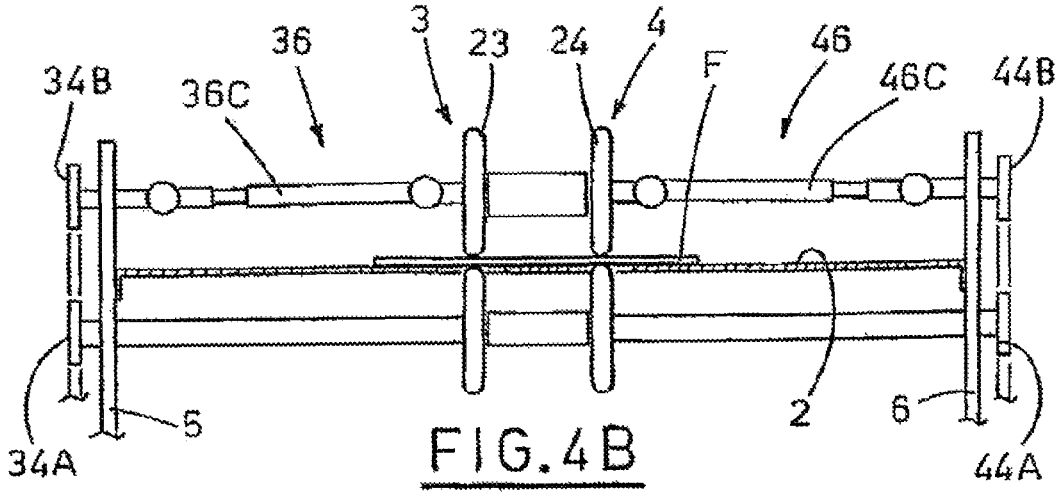

For the application to which reference is made herein, however, it is advisable for the upper rollers 23, 24 to be borne by an elastic suspension 7 (see in particular FIG. 5), which enables them to be raised with respect to the lower rollers 13, 14 consequently to intercepting a sheet F or pile (FIG. 4B), according to the thickness of the sheet or pile, and thereafter to return downwards to the initial level (FIG. 4A).

In this embodiment, therefore, the relative upper axles 36, 46 are jointed and are each constituted by three lengths connected by means of two universal and homokinetic joints 361, 362, 461, 462 (see FIGS. 4A and 4B again).

The central length 36C, 46C of each axle 36, 46 is advantageously length-adjustable, realized for example with a grooved telescopic coupling of known type and not illustrated herein in detail.

Finally, the device 1 comprises command organs 10 for activating the first and second motor organs 30, 40, according to a predetermined program, actuated in phase relation with the arrival of a sheet F or pile, as explained in detail in the following functional description of the device 1.

The program comprises, in order:

synchronized activation of the drawing groups 3, 4 in phase relation with the entry of a sheet F or pile, coming from the upstream branch RM of the transport line L, between the lower rollers 13, 14 and the upper rollers 23, 24 of the groups 3, 4, the activation being such that the two lower rollers 13, 14 rotate in the same direction and consequently the two upper rollers 23, 24 both roll in the opposite direction, the directions being the same as the advancement direction W of the sheet F or pile (FIG. 6);

inversion of the rotation of one of the drawing groups, for example the first group 3, with respect to the other, in phase relation with the reaching by the sheet F or pile of a predetermined advancement position, for example centered with respect to the roller, with a consequent initiation of the horizontal rotation of the sheet F or pile (FIGS. 7 and 8);

continuation of the inverted rotation between the two drawing groups 3, 4 up to when the sheet F or pile reaches a predetermined rotation angle, in the present case a 90° angle (FIG. 9);

resetting of the first drawing group 3 to the initial rotation direction in a same direction as the second group 4, in order to determine the exit of the sheet F or pile, rotated by the said angle, towards the downstream branch RV of the transport line L (FIG. 10).

As is clear from the figures of the drawings, the exit direction of the sheet F or pile is the same as the entry direction, such that the transport line L maintains a straight development. This characteristic is a fundamental pre-requisite in order for high production speeds to be reached.

Thanks to its conformation, the present device can be activated as described in order to impress the desired rotation on the article, or, if necessary, not to do so, leaving out the inversion stage, in order to leave the article with an unaltered orientation between the entry and the exit.

This advantageous possibility significantly increases the versatility of the machine on which the device is mounted.

For different applications to the one described herein, the device is obviously able to perform rotations of the articles to any angle and in either direction.

The constructional simplicity of the described device enables masses and volumes to be contained, in particular in the development direction of the transport line to which it is associated, as well as the production costs.

The foregoing is however intended as a non-limiting example, and any modifications of details which might become necessary for technical and/or functional reasons are considered to fall within the ambit of protection as defined by the following claims.

The invention claimed is:

1. A device for horizontally rotating flat articles supplied along a transport line (L) comprising:

a sliding plane (2) interposed between an upstream branch (RM) and a downstream branch (RV) of the line (L), destined to restingly receive the articles (F) in transit between the branches (RM, RV);

two lower drawing rollers (13, 14), coaxial and having a same diameter, arranged below the sliding plane (2), at openings (2A, 2B) realized therein, such that a common axis of rotation (X1) is horizontal and perpendicular to the transport line (L) and such that an upper limit of the respective external circumferences is not lower than a surface (2S) of the sliding plane (2);

two upper drawing rollers (23, 24) coaxial and having a same diameter, arranged above the lower drawing rollers (13, 14) and aligned there-with, having a common axis of rotation (X2) which is parallel to the axis of rotation (X1) of the lower rollers (13, 14) and defining with the lower rollers (13,14) a first drawing group (3) and a second drawing group (4), flanking one another, each of which is constituted by one of the lower rollers (13, 14) and by a corresponding upper roller (23, 24), with the rollers of each group (3, 4) destined to adheringly engage upper surfaces and lower surfaces of the flat articles (F);

a first motor means (30) and a second motor means (40) destined to operate, independently of one another, the corresponding first drawing group (3) and second drawing group (4), in predetermined rotating directions, such that the rollers of each of the first drawing group (3) and second drawing group (4) are counter-rotating;

command organs (10) for activating the first and second motor means (30, 40) such that: initially the first drawing group (3) and the second drawing group (4) rotate in a same direction, in phase relation with the inlet of a flat article (F) between the rollers of the first and second drawing groups (3,4), the flat article (F) coming from the upstream branch (RM) of the transport line (L); then the first drawing group (3) and the second drawing group (4) rotate in an opposite direction, in order to horizontally rotate the flat article (F) by a predetermined angle; and subsequently the first drawing group (3) and the second drawing group (4) rotate again in a same direction in order to cause the flat article (F), now rotated, to exit towards the downstream branch (RV) of the transport line (L), in a parallel direction to the inlet direction;

first transmission organs (31) and second transmission organs (41), for connecting the first motor means (30) and the second motor means (40) with the corresponding first drawing group (3) and the second drawing group (4), each of the first transmission organs (31) and the second transmission organs (41) being constituted by a drive pulley (32, 42) which by means of a cogged belt or a chain (33, 43) activates two driven pulleys (34A, 34B, 44A, 44B), keyed on a relative lower axle (35, 45) and a relative upper axle (36, 46), connected with a corresponding lower roller (13, 14) and a corresponding upper roller (23, 24).

2. The device of claim 1, characterized in that the lower axles (35, 45) and the upper axles (36, 46) are rigid and define a fixed interaxis between the lower rollers (13, 14) and the upper rollers (23, 24).

3. The device of claim 1, characterized in that the upper rollers (23, 24) of the first drawing group (3) and the second drawing group (4) are supported by an elastic suspension (7), destined to enable the first drawing group (3) and the second drawing group (4) to be raised with respect to the corresponding lower rollers (13, 23) on intercepting a flat article (F), according to a thickness of the flat article (F), and subsequently to be lowered to an initial level, and in that the lower axles (35, 45) are rigid and in that the upper axles (36, 46) are articulated.

4. The device of claim 3, characterized in that the articulated upper axles (36, 46) are each constituted by three sections, connected by means of two universal or homokinetic joints (361, 362, 461, 462) and in that a central section (36C, 46C) of each axle (36, 46) has a variable length.

5. The device of claim 4, characterized in that the variable-length central sections (36C, 46C) exhibit a fluted telescopic coupling.

6. The device of claim 1, characterized in that the sliding plane (2) exhibits a larger breadth than the transport line (L).

7. The device of claim 1, characterized in that the lower drawing rollers (13, 14) and the upper drawing rollers (23, 24) exhibit a same diameter.

* * * * *